US010254063B2

(12) United States Patent
Duhon

(10) Patent No.: US 10,254,063 B2
(45) Date of Patent: Apr. 9, 2019

(54) ROTARY MAGAZINE WITH BOLT HOLD OPEN ASSEMBLY

(71) Applicant: RA BRANDS, L.L.C., Madison, NC (US)

(72) Inventor: Matthew Duhon, Huntsville, AL (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 15/799,440

(22) Filed: Oct. 31, 2017

(65) Prior Publication Data

US 2018/0120043 A1 May 3, 2018

Related U.S. Application Data

(60) Provisional application No. 62/415,732, filed on Nov. 1, 2016.

(51) Int. Cl.
*F41A 9/73* (2006.01)
*F41A 17/36* (2006.01)

(52) U.S. Cl.
CPC ..... *F41A 9/73* (2013.01); *F41A 17/36* (2013.01)

(58) Field of Classification Search
CPC ..... F41A 9/73; F41A 9/74; F41A 9/75; F41A 17/36
USPC ..... 89/188, 189, 190, 33.02, 33.17
See application file for complete search history.

(56) References Cited

U.S. PATENT DOCUMENTS 483,229 A 9/1892 Lindner
608,023 A 7/1898 Blake
1,074,948 A 10/1913 Hiscook
1,563,675 A 11/1919 Johnson et al.
696,118 A 12/1928 Thorsen
1,696,537 A 12/1928 Kewish
2,341,869 A 2/1944 Johnson, Jr.
3,098,311 A 7/1963 Savioli
3,171,225 A 3/1965 Green et al.
3,177,601 A * 4/1965 Meunier ..... F41A 17/36 42/18
3,239,959 A 3/1966 Sefried, II et al.
3,319,523 A * 5/1967 Casull ..... F41A 9/74 42/106
3,570,366 A 3/1971 Nickel
3,688,640 A 9/1972 Seecamp
3,745,687 A 7/1973 Koon, Jr.
3,846,928 A * 11/1974 Ruger ..... F41A 17/36 42/16
4,016,356 A 4/1977 Maillard
4,056,038 A 11/1977 Rath
4,069,607 A 1/1978 Jerek
(Continued)

OTHER PUBLICATIONS http://cstmtech.com/10-22bsg/; CST-Custom Shooting Technologies; "*The CST Titan 22 Receiver is Now Available!*" "*CST 2nd Generation Auto Bolt Stop with The New Power Match 10/22 Bolt*".

*Primary Examiner* — Bret Hayes
(74) *Attorney, Agent, or Firm* — Womble Bond Dickinson (US) LLP

(57) ABSTRACT

A bolt hold open assembly for a rotary magazine may include a bolt hold open lever movable to a locked position to inhibit forward motion of the bolt after firing the last round of ammunition. The bolt hold open lever may be moved to the locked position by a bolt hold open riser that is activated by a paddle movable with the rotor assembly of the rotary magazine.

17 Claims, 11 Drawing Sheets

(56) References Cited

U.S. PATENT DOCUMENTS

| | | | | |
|---|---|---|---|---|
| 4,069,608 | A | 1/1978 | Jerek | |
| 4,079,535 | A | 3/1978 | Elbe et al. | |
| 4,176,584 | A * | 12/1979 | Thomas, Jr. | F41A 17/38 89/138 |
| 4,332,097 | A | 6/1982 | Taylor, Jr. | |
| 4,453,329 | A | 6/1984 | Brint et al. | |
| 4,455,919 | A | 6/1984 | Osborne et al. | |
| 4,487,103 | A | 12/1984 | Atchisson | |
| 4,617,749 | A | 10/1986 | Jurek | |
| 4,672,760 | A | 6/1987 | Chesnut et al. | |
| 4,689,907 | A | 9/1987 | Gwinn, Jr. | |
| 4,790,094 | A | 12/1988 | Chesnut et al. | |
| 4,862,620 | A | 9/1989 | Chesnut et al. | |
| 4,901,463 | A | 2/1990 | Chesnut | |
| 4,974,366 | A | 12/1990 | Kelsey, Jr. et al. | |
| 5,375,359 | A | 12/1994 | Chesnut et al. | |
| 5,588,241 | A | 12/1996 | Hurley | |
| 6,502,495 | B1 | 1/2003 | Beary | |
| 6,510,778 | B1 | 1/2003 | Irwin | |
| 6,606,811 | B1 | 8/2003 | Olson | |
| 7,261,029 | B1 | 8/2007 | Davis | |
| 7,941,955 | B2 | 5/2011 | Stone | |
| 8,302,340 | B1 | 11/2012 | Irwin | |
| 8,359,966 | B1 * | 1/2013 | Brotherton | F41A 17/36 42/70.02 |
| 8,387,296 | B2 | 3/2013 | Overstreet et al. | |
| 8,479,635 | B2 | 7/2013 | Overstreet et al. | |
| 8,572,875 | B2 | 11/2013 | Sisgold | |
| 8,677,880 | B2 | 3/2014 | Bowles et al. | |
| 8,746,912 | B2 | 6/2014 | Heath | |
| 9,091,499 | B2 | 7/2015 | Overstreet et al. | |
| 9,228,788 | B1 | 1/2016 | Simon et al. | |
| 9,291,412 | B1 * | 3/2016 | Montes | F41A 17/36 |
| 9,605,918 | B1 | 3/2017 | Ballard | |
| 9,939,217 | B2 | 4/2018 | Muska | |
| 10,006,731 | B2 | 6/2018 | Findlay et al. | |
| 2005/0000138 | A1 | 1/2005 | Kiss | |
| 2012/0117840 | A1 | 5/2012 | Chewning et al. | |
| 2013/0174456 | A1 | 7/2013 | Ricks | |
| 2014/0075810 | A1 | 3/2014 | Mikroulis | |
| 2018/0003454 | A1 * | 1/2018 | Muska | F41A 9/73 |

* cited by examiner

ROTARY MAGAZINE WITH BOLT HOLD OPEN ASSEMBLY

CROSS REFERENCE TO RELATED APPLICATIONS

The present patent application claims the benefit of the filing date of previously filed, U.S. Provisional Patent Application No. 62/415,732, filed Nov. 1, 2016 by the inventor named in the present Application.

INCORPORATION BY REFERENCE

The specification and drawings of U.S. Provisional Patent Application No. 62/415,732, filed Nov. 1, 2016, are specifically incorporated herein by reference as if set forth in their entirety.

TECHNICAL FIELD

This disclosure is, in one aspect, drawn to firearms, in particular, rotary magazines for firearms.

BACKGROUND

A bolt hold open lever generally operates to inhibit forward motion of the bolt assembly of a firearm after discharge of the last round of ammunition has been fed from a magazine, such as a box magazine of the firearm. However, rotary magazines typically do not house any mechanism that can engage/actuate the bolt hold open lever of a firearm upon firing of the last round. In particular, with rotary magazines, a round that is being stripped out of the magazine by the bolt is generally held in place by a next round in the cylinder, but the last round to be fed does not have another round following it to hold it in position. As a result, an extrusion on the rotary cylinder generally is used to lift the last round into place to be stripped out by the bolt. Due to limited space inside of most rotary magazines, however, the extrusion on the cylinder typically contacts the feed throat while holding the last round in place, such that, there is little to no additional rotation of the cylinder provided to operate a bolt hold open lever after the last round has left the magazine. Therefore, typical rotary magazines generally cannot activate a conventional bolt hold open lever, such as for an AR or M4 style firearm, to arrest forward movement of the bolt assembly after the last round has been fired. This can cause damage to the firearm as the bolt is moved to its forward position without a round to engage or strip. While rotary magazines have been developed with parts that are located so as to block the bolt, they generally operate to block the bolt at or toward the end of its return path of travel, where the inertial force of the moving bolt is substantial, which force can damage or break such blocking parts.

Accordingly, it can be seen a need exists for a rotary magazine with a bolt hold open assembly to inhibit movement of the bolt as it is cycled forward after firing of the last round, and which addresses the foregoing and other related, and unrelated, problems in the art.

SUMMARY

Briefly described, in one aspect, this disclosure is directed to a rotary magazine assembly having a body within which a cylinder or rotor is received and rotates for feeding rounds of ammunition to the chamber of a firearm, such as an AR style firearm. The rotary magazine assembly can comprise a bolt hold open engagement assembly, including protruding portion, such as a paddle, in communication with the rotor of the magazine and configured to activate a bolt hold open lever of the firearm to hold/maintain the bolt in its open position after the last round has been fired. The body of the rotary magazine will define a magazine housing generally sized, dimensioned, and/or configured to be received at least partially within a magazine well of the firearm, and can include front, rear, side, top and bottom portions that define an interior cavity sized to receive/store a series of rounds of ammunition. The magazine rotor can comprise a cylindrical body with a series of spaced projections that define recesses configured to receive and hold at least a portion of the rounds loaded within the magazine. The rotor will be rotationally biased to feed the rounds through a feed throat provided in the magazine body as the rounds are stripped by the bolt assembly and fed into/towards the chamber of the firearm. The rotor further can have a follower attached thereto, and which is pivotable/rotatable to an extent sufficient to at least partially enter the feed throat and urge the last round in the magazine through the feed throat to a location or position for stripping by the bolt assembly of the firearm.

The bolt hold open engagement assembly/system is adapted to engage and actuate a bolt hold open lever positioned along the receiver to move the bolt hold open lever to a raised, locking position that will hold or lock the bolt assembly in its open position from a lowered, open position that allows the bolt assembly to freely translate/move about the receiver. For example, the bolt hold open engagement assembly can be operable with an existing bolt hold open lever of the firearm in which the rotary magazine is received. The bolt hold open engagement assembly/system will include a protruding portion, e.g., a paddle, bump, knob, or other protuberance, positioned/arranged along the rotor of the magazine at a proximal end thereof and configured to activate or move the bolt hold open lever to its locking or engaged position after firing of the last round of ammunition.

In one embodiment, the protruding portion/paddle will rotate with the rotor and can be brought into engagement with a bolt hold open riser that is slidably or movably arranged along the magazine body or housing. The bolt hold open riser can be at least partially received within the interior cavity defined by the magazine housing, and include a riser body with a protruding portion or area that has an engagement surface located/positioned to be contacted by at least a portion of the protruding portion of the rotor as or after the last round of ammunition is fed through the feed throat of the magazine. The magazine follower also may be configured to move a sufficient distance along/into the feed throat to allow for sufficient rotation of the protruding portion of the rotor to move or engage the bolt hold open riser into a position to engage at least a portion of the bolt hold open lever of the firearm.

Such engagement will activate and cause the bolt hold open lever to move from its lowered, non-engaging position to its raised, locking or engaged position to hold the bolt assembly in an open condition and substantially retard or prevent forward movement of the bolt assembly along the receiver after the last round has been fired. A notch or recess defined by a body of the bolt hold open lever may engage or be contacted by at least a portion of the bolt assembly as the bolt assembly is cycled forward, which notch may be sized, configured and/or dimensioned so that the engagement thereof by the bolt assembly creates a sufficient frictional engagement so as to at least partially maintain the bolt hold open lever in its engaged position as the bolt assembly initially begins cycling forward direction and before the bolt assembly generates a substantial amount of momentum or velocity in the forward direction, which can help reduce and/or substantially minimize the impact of the bolt assembly against the bolt hold open lever and the magazine components to thereby prevent damage to the bolt assembly, bolt hold open lever, the magazine and/or other components of the firearm.

Various features, objects and advantages of the present disclosure will become apparent to those skilled in the art upon a review of the following detailed description, when taken in conjunction with the accompanying drawings.

BRIEF DESCRIPTION OF THE DRAWINGS

It will be understood that the drawings accompanying the present disclosure, which are included to provide a further understanding of the present disclosure, are incorporated in and constitute a part of this specification, illustrate various aspects, features, advantages and benefits of the present disclosure, and together with the following detailed description, serve to explain the principals of the present disclosure. In addition, those skilled in the art will understand that, accordingly, in practice, various features of the drawings discussed herein are not necessarily drawn to scale, and that dimensions of various features and elements shown or illustrated in the drawings and/or discussed in the following Detailed Description may be expanded, reduced or moved to an exploded position in order to more clearly illustrate the principles and embodiments of the present disclosure as set forth herein.

DETAILED DESCRIPTION

Referring now in greater detail to the drawings in which like numerals indicate like parts throughout the several views, as shown in FIGS. 1-9, the present disclosure generally relates to a bolt hold open assembly or system for a rotary magazine 10, such as use with rimfire ammunition, that allows for retention of the bolt assembly 9 of a firearm F in an open position after the last round has been fired. The present rotary magazine with its bolt hold open assembly can be operable with the bolt hold open lever existing or as provided with a firearm, such as an AR-style or M4 type firearm, without necessarily requiring a new or replacement bolt hold open lever. The ability to use the existing firearm bolt hold open lever or one with a similar configuration and/or placement allows the bolt assembly to translate freely along the receiver, in normal conventional operation, and when activated, substantially arrests or otherwise inhibits forward movement of the bolt assembly along the receiver in a manner such that after reaching the end of its path of travel, the subsequent forward movement of the bolt may be substantially arrested or stopped by the bolt hold open lever just as the bolt assembly begins to cycle forward to substantially lessen the impact between the bolt assembly and the bolt hold open lever and help prevent damage or wear between the bolt assembly, bolt hold open lever, magazine, and/or other components of the firearm.

Figure 1:
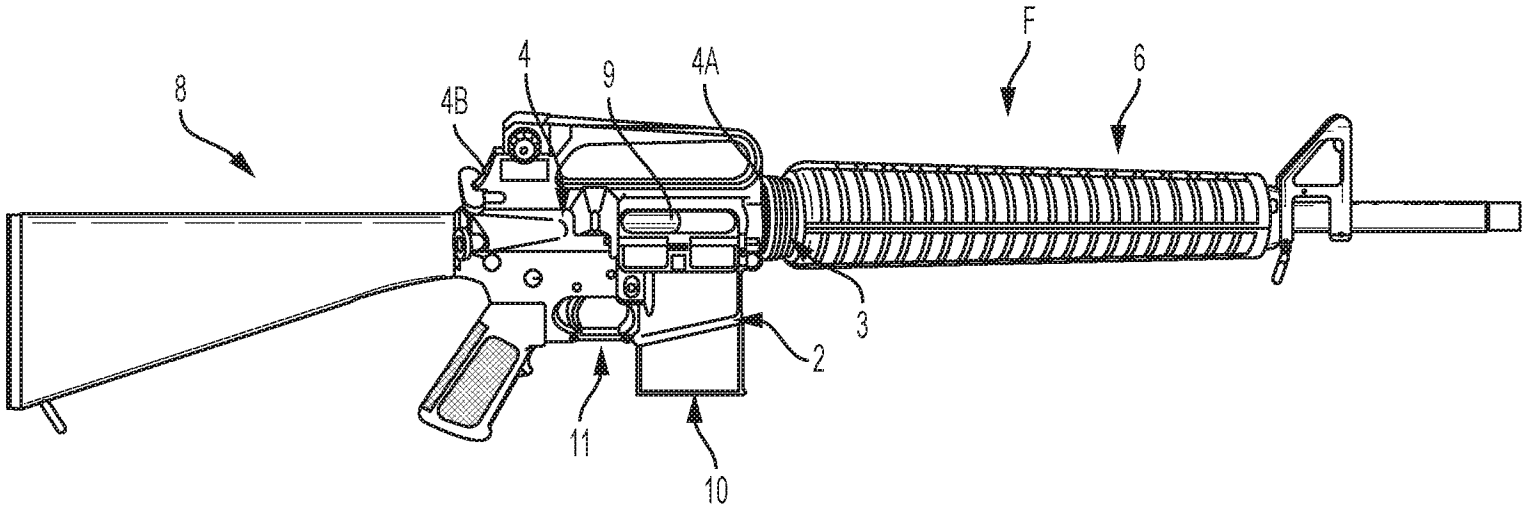
FIG. 1 shows a firearm for use with a rotary magazine according to principles of this disclosure.

As indicated in FIG. 1, rotary magazine 10 of the present disclosure can be used with firearms F that generally may include, but not be limited to, rifles, such as an AR-style rifle, and other types of long guns, although various other types of firearms, including pistols or handguns also can be used without departing from this disclosure. The rotary magazine 10 is generally configured to be received within the magazine well 2 of the firearm F so as to supply a series of rounds 100 of ammunition of a selected caliber (i.e., 5-10 rounds, though more or less rounds also can be provided) to the chamber 3 of the firearm F. The firearm F will include a receiver 4; a barrel assembly 6 mounted to the receiver 4 at a front end 4A thereof and defining a chamber 3 at a location where the barrel assembly 6 connects to the receiver 4; and a butt stock assembly 8 mounted along a rear end 4*b* of the receiver 4. A bolt assembly 9 having one or more lugs is slidably received within the receiver 4 for operation of the firearm F, and can include, for example, a stripping lug 9*a* that can contact/engage a portion of an uppermost round of ammunition 100 (FIG. 6) stored in the magazine and force/urge the round 100 toward and into the chamber. After firing of the firearm, the bolt assembly may be driven or translated in a rearward direction, e.g., using a gas impingement or a piston assembly, after which the bolt assembly 9 will be cycled in the forward direction, such as by a spring or other suitable biasing mechanism, for stripping of a next round from the magazine and loading into the chamber. A fire control 11 further will be mounted to the receiver 4 including a trigger for controlling firing of the firearm F, as generally shown in FIG. 1.

Figure 2:
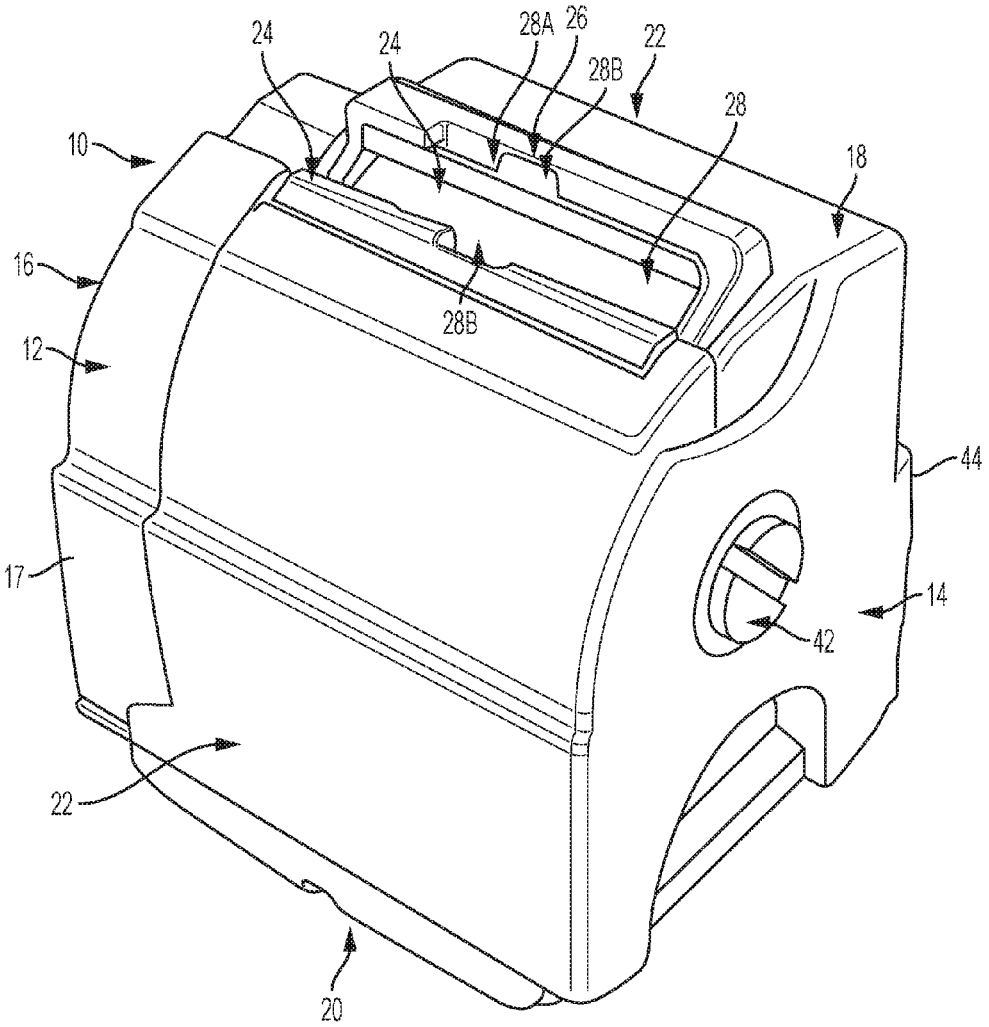
FIG. 2 is a perspective view of the rotary magazine shown in FIG. 1.

FIG. 2 shows the rotary magazine 10 according to one example embodiment, including a magazine housing or body 12 having front 14, back 16, top 18, bottom 20 and side 22 walls or portions that at least partially define an interior cavity or compartment 24 sized to receive and house rounds of ammunition of a selected caliber or size. The magazine body can be formed from various metal and/or plastic or synthetic materials. The rear or back portion/wall 16 of the magazine housing 12 further can include a back plate 17 that can be formed with or can be removably coupled to the magazine housing 12 to provide access to the interior cavity 24, for example, for cleaning, maintenance and/or replacement of the components housed/received therein. As additionally shown in FIGS. 2 and 6, the top portion 18 of the magazine housing 12 will include a feed throat 26 with feed lips or guide portions/surfaces 27 along an opening or aperture 28 at the top of the feed throat 26 that is sized to receive the rounds 100 therethrough. The feed lips or guide surfaces 27 can be formed with or from the same material as the magazine housing, and also can be formed of a metal or higher strength material and mounted along the sides of the throat 26 as indicated in FIGS. 2 and 6.

The rounds of ammunition 100 (FIG. 6) will be loaded into the magazine housing 12 through the opening 28, and when the rotary magazine 10 is received within the magazine well 2 of the firearm F, the rounds 100 can be fed through the feed throat 26 so that the rounds 100 at least partially extend out of the opening 28 and in a position or orientation so they can be stripped by the bolt assembly 9 and moved into/towards the chamber of the firearm for firing. The opening 28 of the feed throat 26 also can have guide surfaces 28A arranged therealong to help in the engaging and guiding of the rounds toward the chamber as they are stripped by the bolt assembly and fed/urged toward the chamber 3. These guide surfaces 28A further can have notches or recesses 28B defined therein to accommodate the rim 102 of each round 100 to facilitate loading and feeding of the rounds into and out from the magazine housing 12 as shown in FIG. 2.

Figure 3:
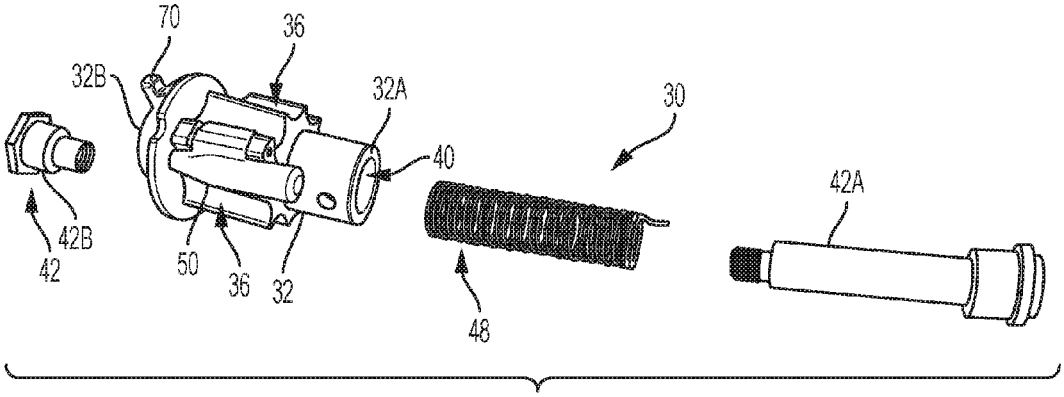
FIG. 3 shows an exploded view of the rotor assembly for the rotary magazine of FIG. 2.
Figure 4A:
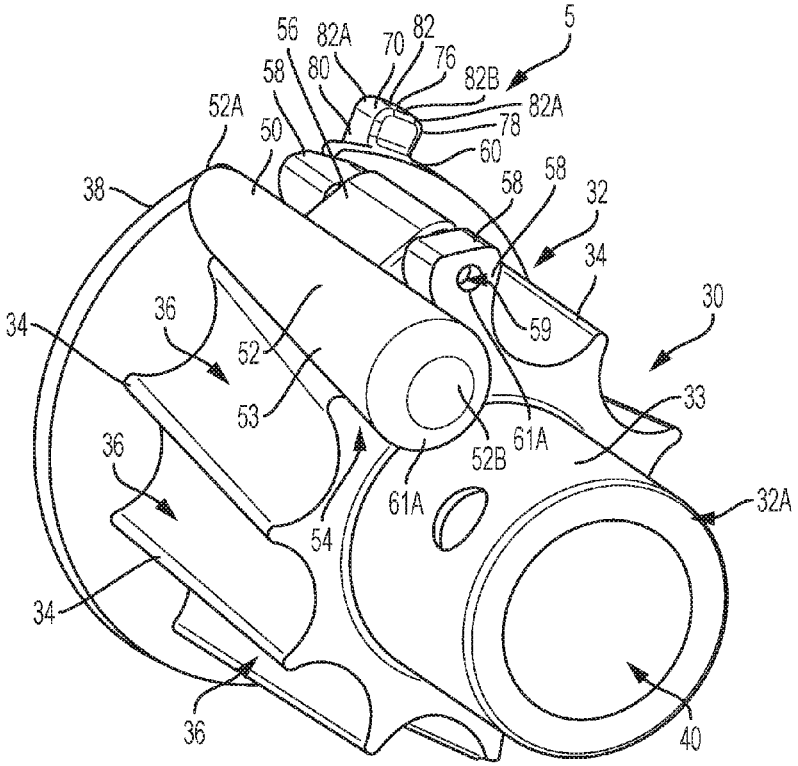
FIGS. 4A-D are perspective views of the rotor for the rotary magazine shown in FIG. 2.
Figure 4B:
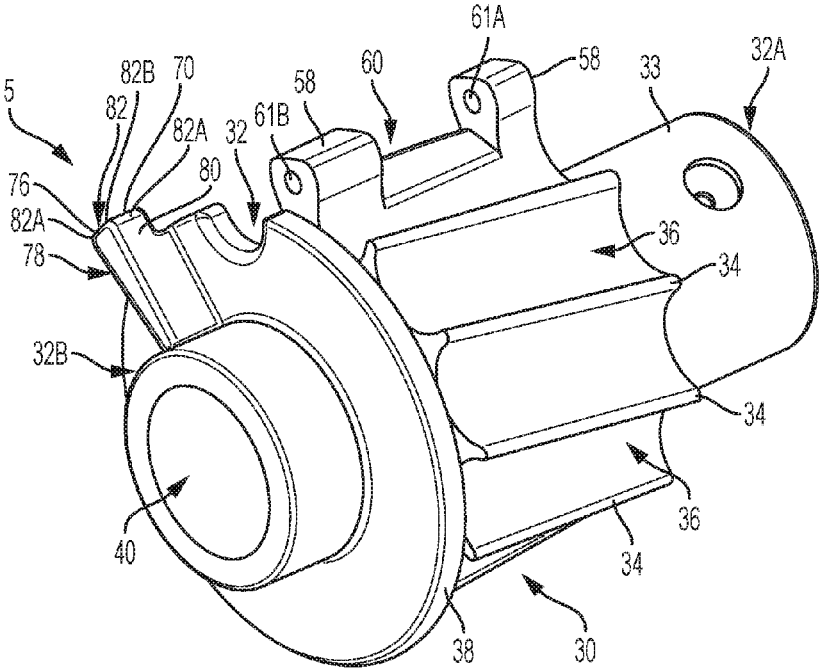
Figure 4C:
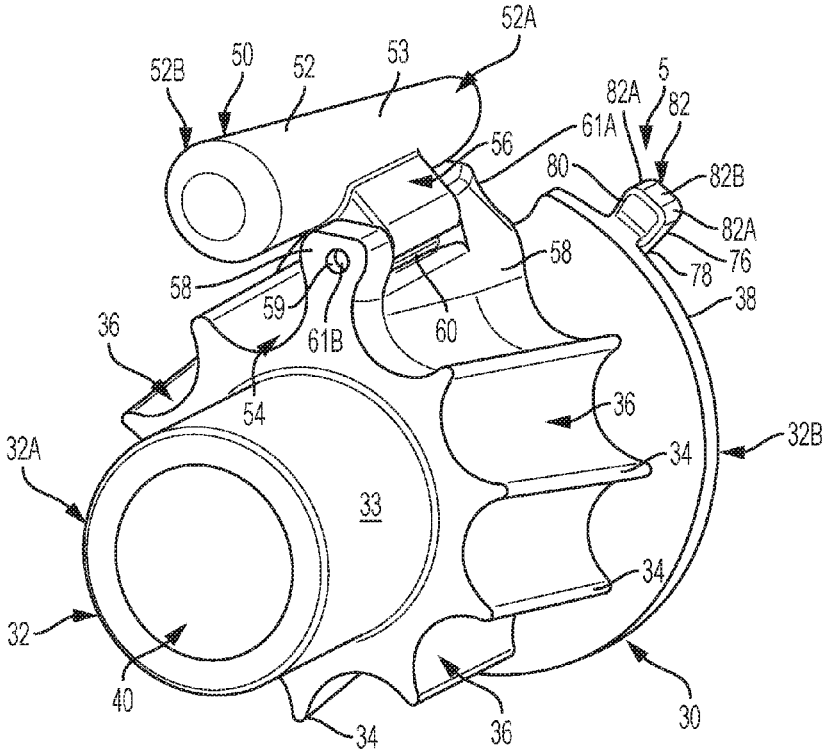
Figure 4D:
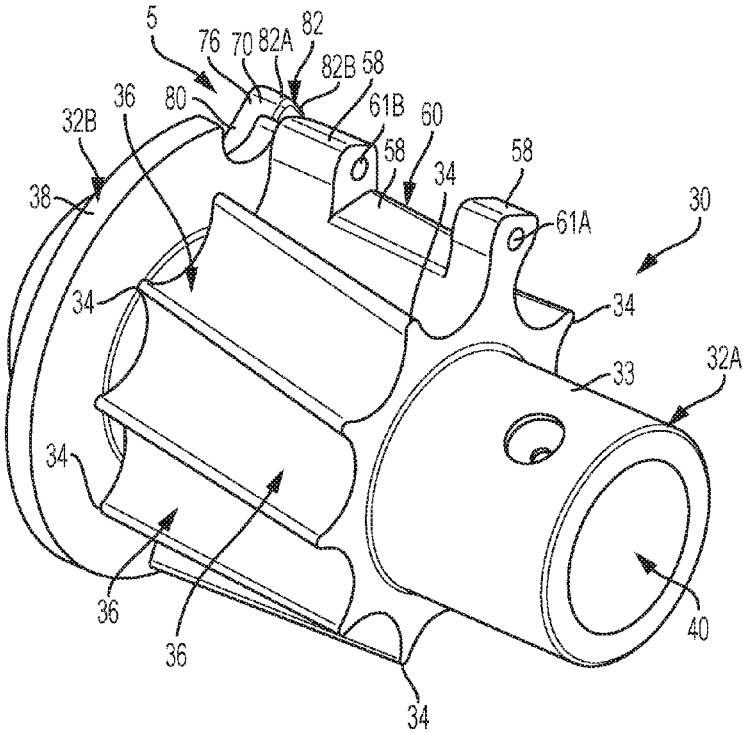

As shown in FIGS. 3, 4A-D, and 6-7, the rotary magazine 10 will comprise a cylinder or rotor assembly 30 at least partially housed within the magazine housing 12. The rotor assembly 30 can be formed from various metal or synthetic materials and can have an elongated rotor body 32 with distal 32A and proximal 32B ends and a generally tubular or cylindrical shape, though other shapes are possible, such as oval, square, rectangular, etc., without departing from this disclosure. The rotor body 32 can be formed of a plastic material, though other materials, such as wood or laminates, ceramic, metal, carbon composites or other suitable materials can be employed, without departing from this disclosure. The elongated body 32 further may include a series of projections 34 spaced about an exterior or peripheral surface 33 of the body 32, which spaced projections 34 can define recesses or grooves 36 that are shaped, sized, dimensioned, or otherwise configured to at least partially receive and hold or support the rounds 100 loaded into the interior cavity 24 of the magazine housing 10. Additionally, as shown in FIGS. 4A and 4C, a flange or projection 38 can be arranged proximate or adjacent the projections/recesses 34/36 along the rotor body 32, which flange/projection 38 can be configured to engage a rear portion, or the rim 102, of the rounds 100 to align or support the rounds 100 within the projections/recesses 34/36 of the rotor. The round retention flange or projection 38 generally is shown with a disk-like or circular shape, though the flange/projection 38 further may have any suitable shape to at least partially align and retain the rounds 100 without departing from this disclosure.

Figure 5:
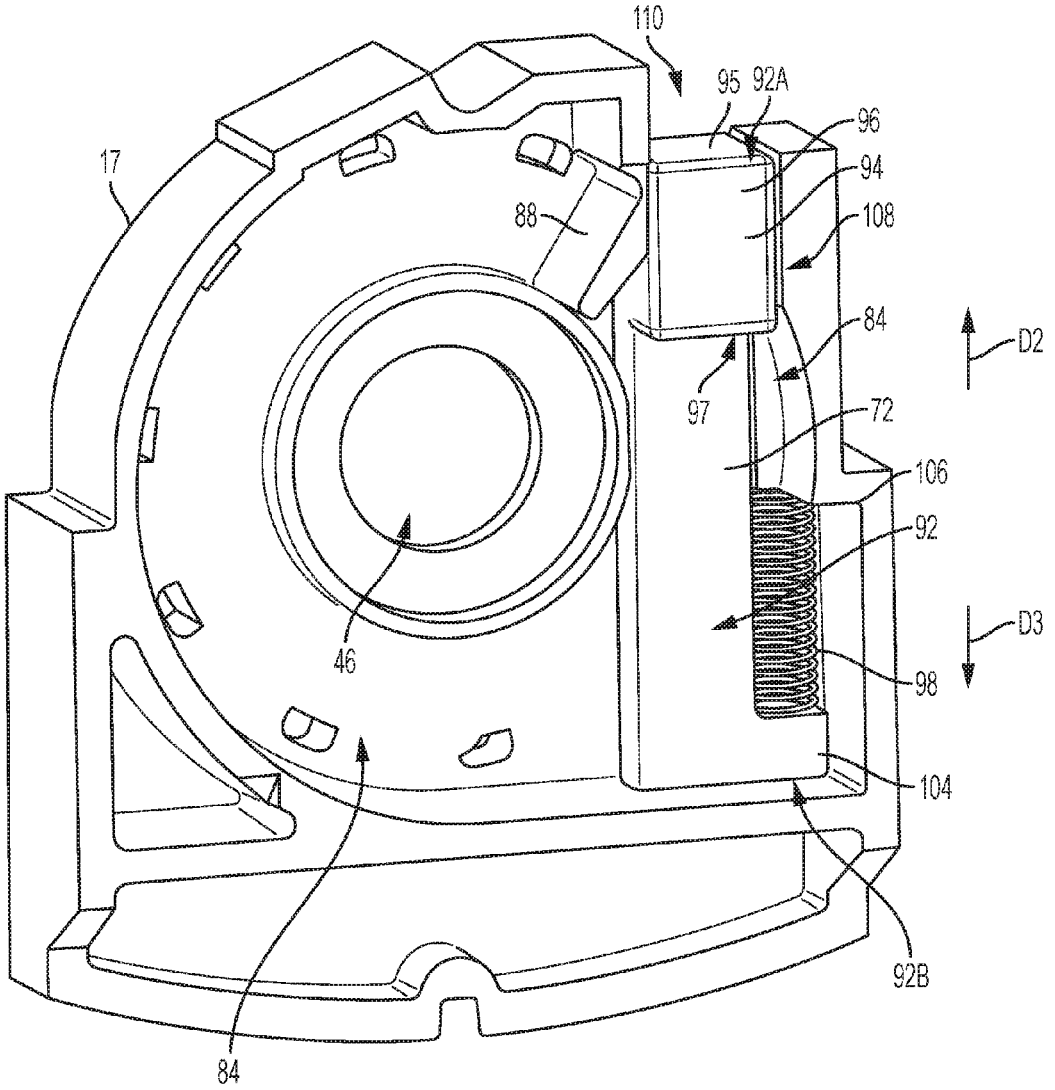
FIG. 5 is a perspective view of a back plate of the rotary magazine of FIG. 2.
Figure 6:
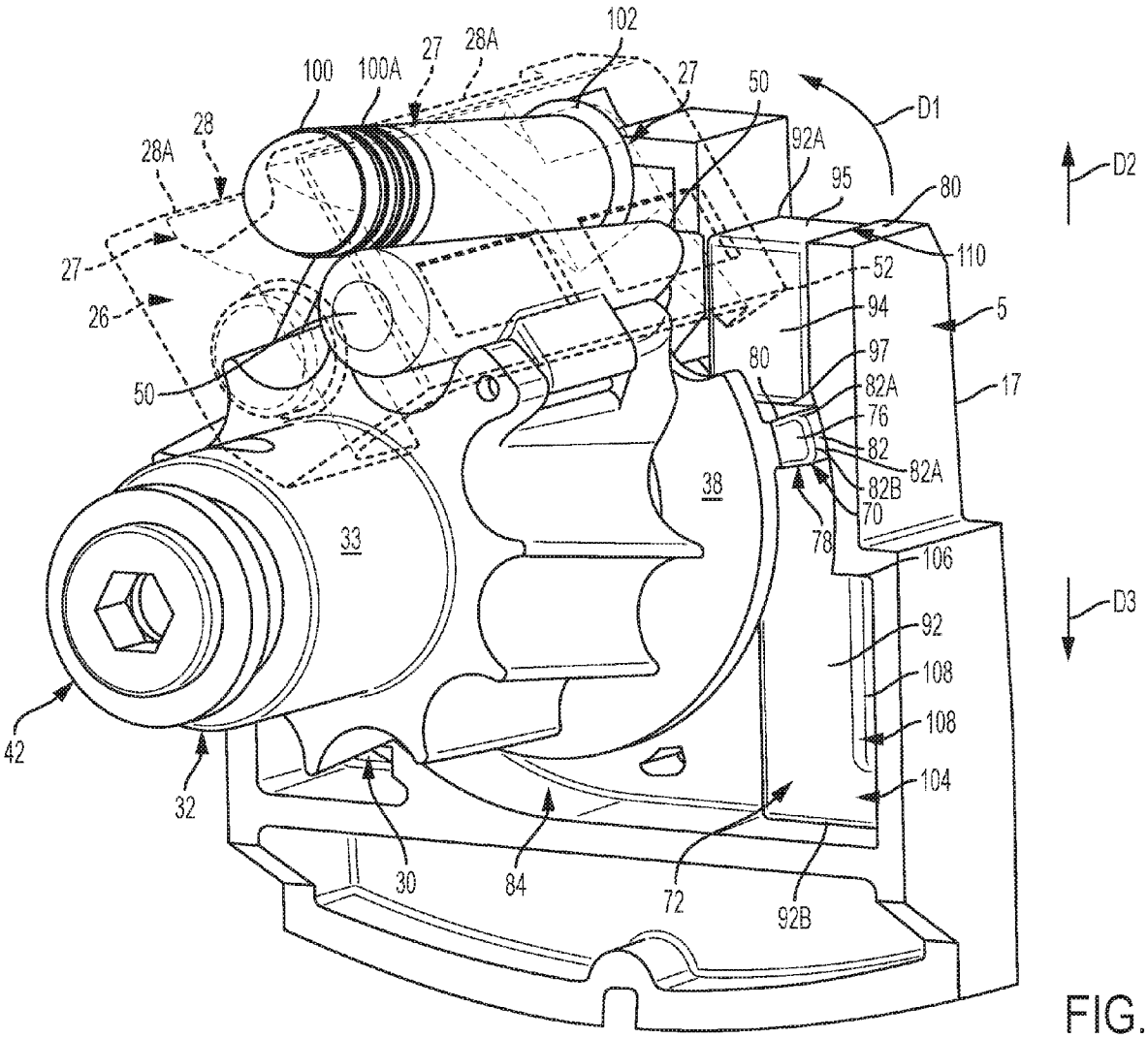
FIG. 6 is a perspective view of the rotor and back plate of the rotary magazine of FIG. 2, with a last round being fed through the feed throat.
Figure 7:
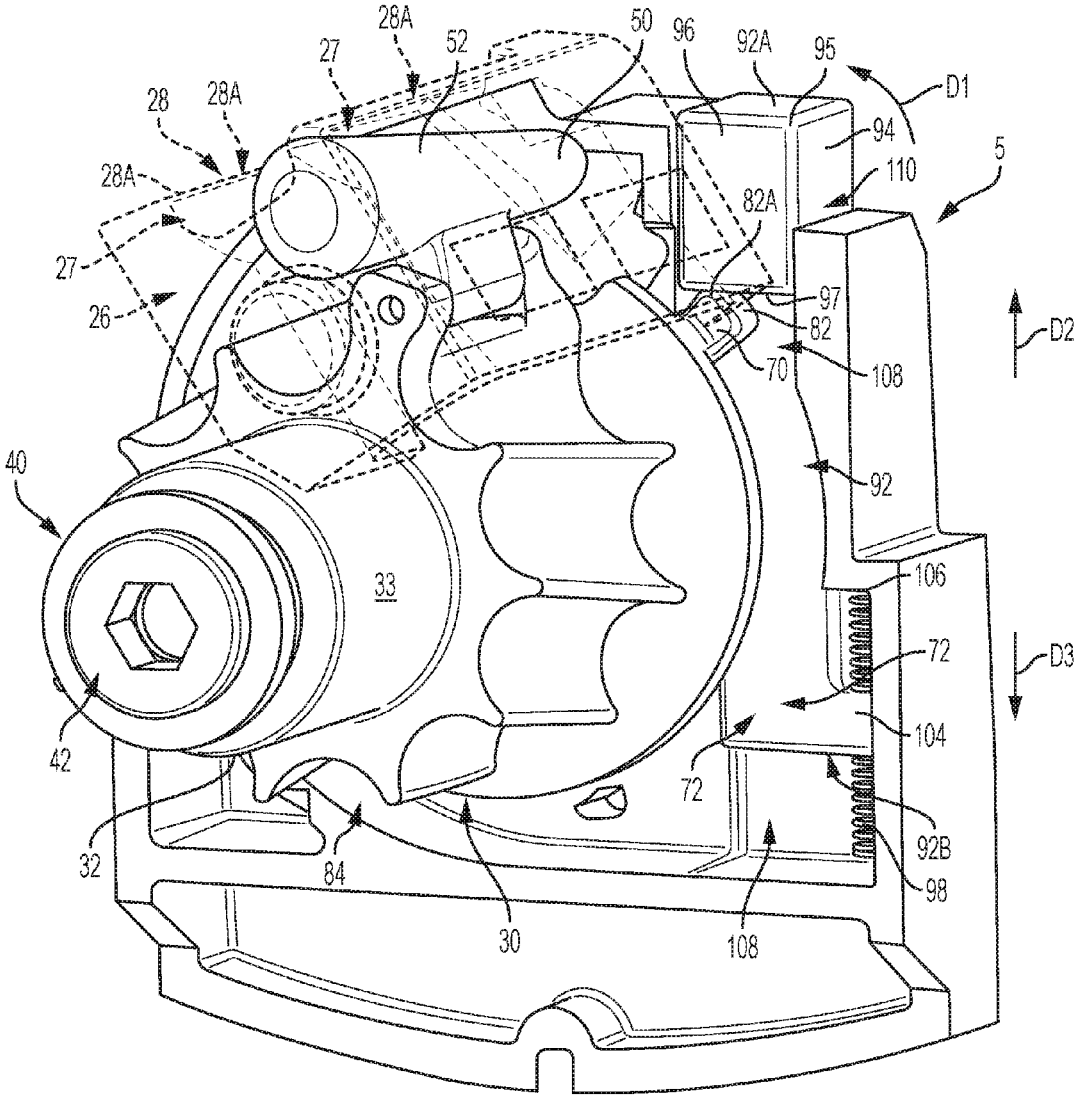
FIG. 7 is a perspective view of the rotor and back plate of the rotary magazine of FIGS. 2 and 6, after the last round has been fired.

As illustrated in FIGS. 6-7, the rotor 30 is rotatable, or otherwise movable, within the magazine housing 12 so that the rotor body 32 can feed the rounds positioned thereabout towards and through the feed throat 26 of the magazine so that the rounds can be stripped by the bolt assembly 9 and fed towards/into the chamber 3. The rounds 100 may be moved or urged through the feed throat 26 by an adjacent or lower round as the rotor rotates such that the round 100 extends at least partially out of the opening 28 of the feed throat 26 to an extent sufficient to enable the lug 9*a* of the bolt assembly to engage the rear portion of the round and move the round along the guide surfaces 28A toward/into the firearm chamber. For example, as shown in FIG. 3, to movably mount the rotor body 32 within the magazine housing 12, the rotor body 32 may have a passageway 40 defined therethrough that is configured to receive an axle or bolt assembly 42, with a pin or bolt 42A and threaded nut or hub 42B, for rotatably mounting the rotor body 32 within the interior cavity 24 of the magazine housing 12 (FIG. 3), though other suitable fixing mechanisms, e.g., a screw, rivet, pin, or press-stud, can be used without departing from this disclosure. The fastener 42 further may be received within an opening or aperture 44 (FIG. 3) formed in the front portion 14 of the magazine housing 12 and an opening or aperture 46 (FIG. 5) formed in the removable back plate 17 of the magazine housing to rotatably mount the rotor body within the interior cavity of the magazine housing, such as shown in FIGS. 2 and 5. This fastener assembly also may couple or fix the back plate 17 to the magazine housing so that it can be removable therefrom by loosening and removal of the bolt 42A (FIG. 3).

In addition, a biasing mechanism 48, such as a torsion spring or other suitable biasing mechanism, may be positioned or received along the axle or bolt body 42 to rotatably bias the rotor body 32, and thus the rounds of ammunition disposed/received thereabout in a counterclockwise direction D1 (FIGS. 3 and 6). Thus, after a round has been stripped by the bolt assembly and fed towards/into the chamber of the firearm, the rotor body may be further rotated or moved, e.g. under the power of the spring 48, to feed a next rounds 100 toward/through the feed throat 26 of the magazine such that the next round is positioned along the opening for stripping by the bolt assembly. Though the rotor body is shown to be biased in a counterclockwise direction D1, the rotor body further may be biased in the clockwise direction to feed the rounds of ammunition (FIGS. 6-7) without departing from this disclosure.

As generally shown in FIGS. 4A, 4C, and 6-7, the rotary magazine assembly 30 further can include a follower 50 that is operable to move or urge a last round of ammunition 100A through the feed throat 26 of the magazine. The follower 50 also may include an elongated body 52 sized and dimensioned to be at least partially received within a recess or groove 54 arranged along the rotor body 32. The follower body 52 typically can have a substantially cylindrical shape, such as being shaped and/or configured similar to a round of ammunition, though other shapes are possible without departing from this disclosure. In one example, as shown in FIGS. 4A, 4C, and 6-7, the follower body may have a maximum diameter at a distal end 52A thereof and a minimum diameter at its proximal end 52B, or can have a substantially consistent diameter along its length. The recess 54 of the rotor body 32 in which the follower 50 is at least partially received similarly may be sized, dimensioned, or configured to be complementary or substantially conform to the follower body 52. In addition, the follower body 52 may be pivotably or rotatably coupled to the rotor body 32 to allow the follower 50 to at least partially move within and along the feed throat 26 to at least partially engage and force/move the round(s) therethrough (FIGS. 6-7).

In one example embodiment, as shown in FIGS. 4A, 4C and 6-7, the follower 50 can include a flange or other protruding portion 56 arranged along a circumferential or peripheral surface 53 of the follower body 52, which flange/portion 56 can be coupled between a pair of projections 58 formed along the rotor body 32, such as by a pin or rod 59, so that the follower 50 is movable, pivotable or rotatable. The projections 58 may define a recess or notch 60 between which the flange 56 is received, and will have openings 61A/B defined therethrough that are sized to receive the pin or rod 59 therethrough. This arrangement/construction allows for rotation of the follower 50 as it enters and moves along the feed throat of the magazine so that the follower 50 may lift or urge the last round of ammunition towards the top opening of the feed throat so that the last round can be stripped and fed by the bolt assembly into the chamber of the firearm (FIG. 6).

The magazine assembly further will include a bolt hold open assembly 5 for maintaining the bolt of the firearm in a locked open position after the last round fed from the magazine has been fired. For example, the bolt hold open assembly 5 may operate stop or inhibit motion of the bolt assembly 9 as it is cycled forwardly along the receiver after the last round of ammunition has been discharged. The forward motion of the bolt assembly may be stopped/arrested after the bolt assembly begins to move (or initially moves) in the forward direction during cycling such that the bolt assembly will be substantially prevented or deterred from exceeding a selected velocity or generating a significant amount of force or momentum in the forward direction to, e.g., prevent damage or wear to the bolt assembly/the magazine, and/or other components of the firearm. In one example, as shown in FIGS. 4A-D and 6-7, the bolt hold open assembly 5 can include a paddle, bump, knob, protuberance, and/or other protruding portion 70 arranged proximate or adjacent the proximal or rear end 32B of the rotor body 32, and which paddle 70 can be configured to engage or activate a bolt hold open riser 72, which is in communication with a bolt hold open lever 74 (FIG. 8) of the firearm, so as to move the bolt hold open lever 74 to a locking position sufficient to hold the bolt assembly 9 in an open position, or at least substantially arrest the forward movement thereof, after the last round of ammunition has been fired.

Figure 8:
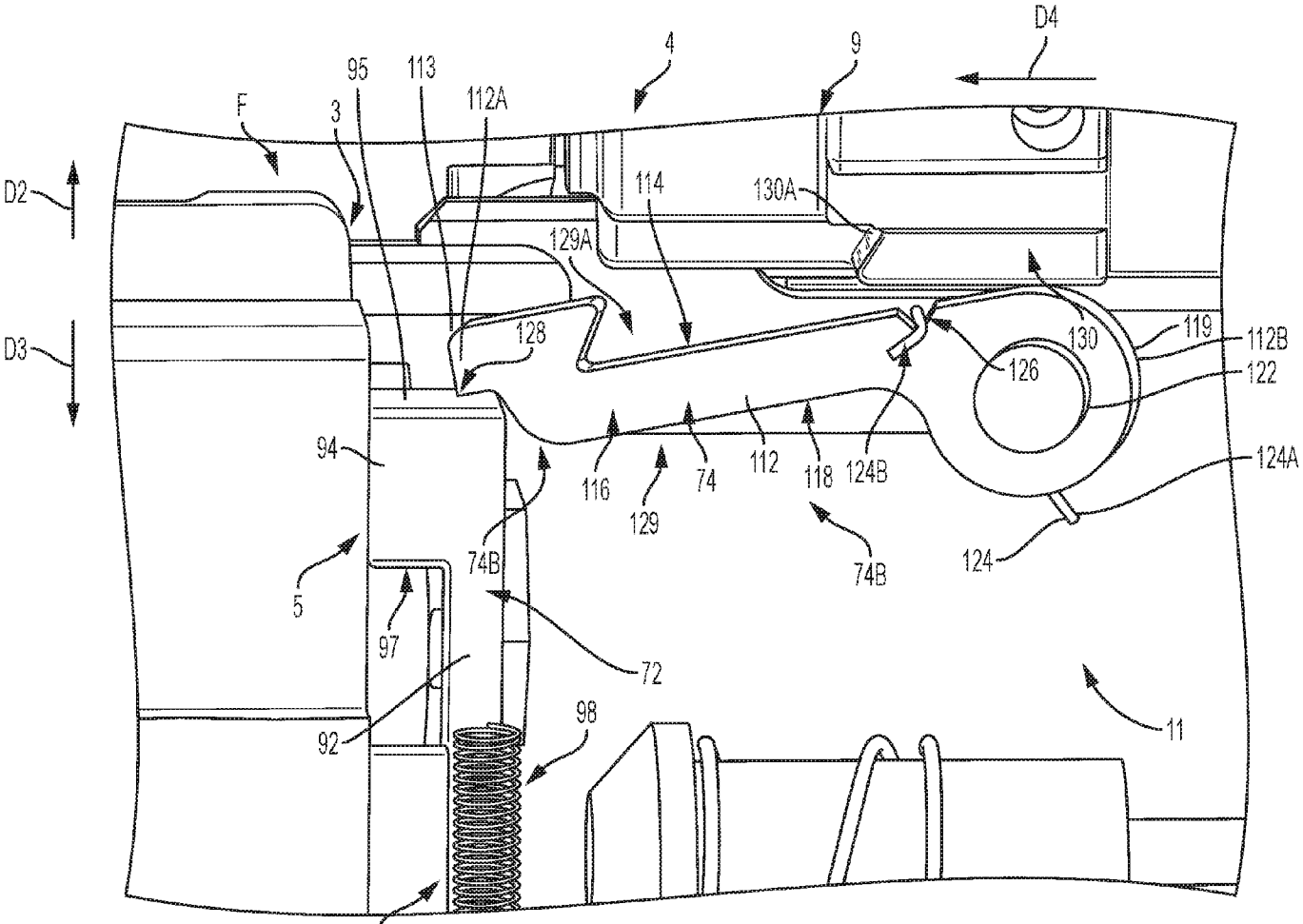
FIG. 8 is a side view of the bolt hold open assembly/system according to principles of the disclosure, with the bolt hold open lever in an open position.
Figure 9:
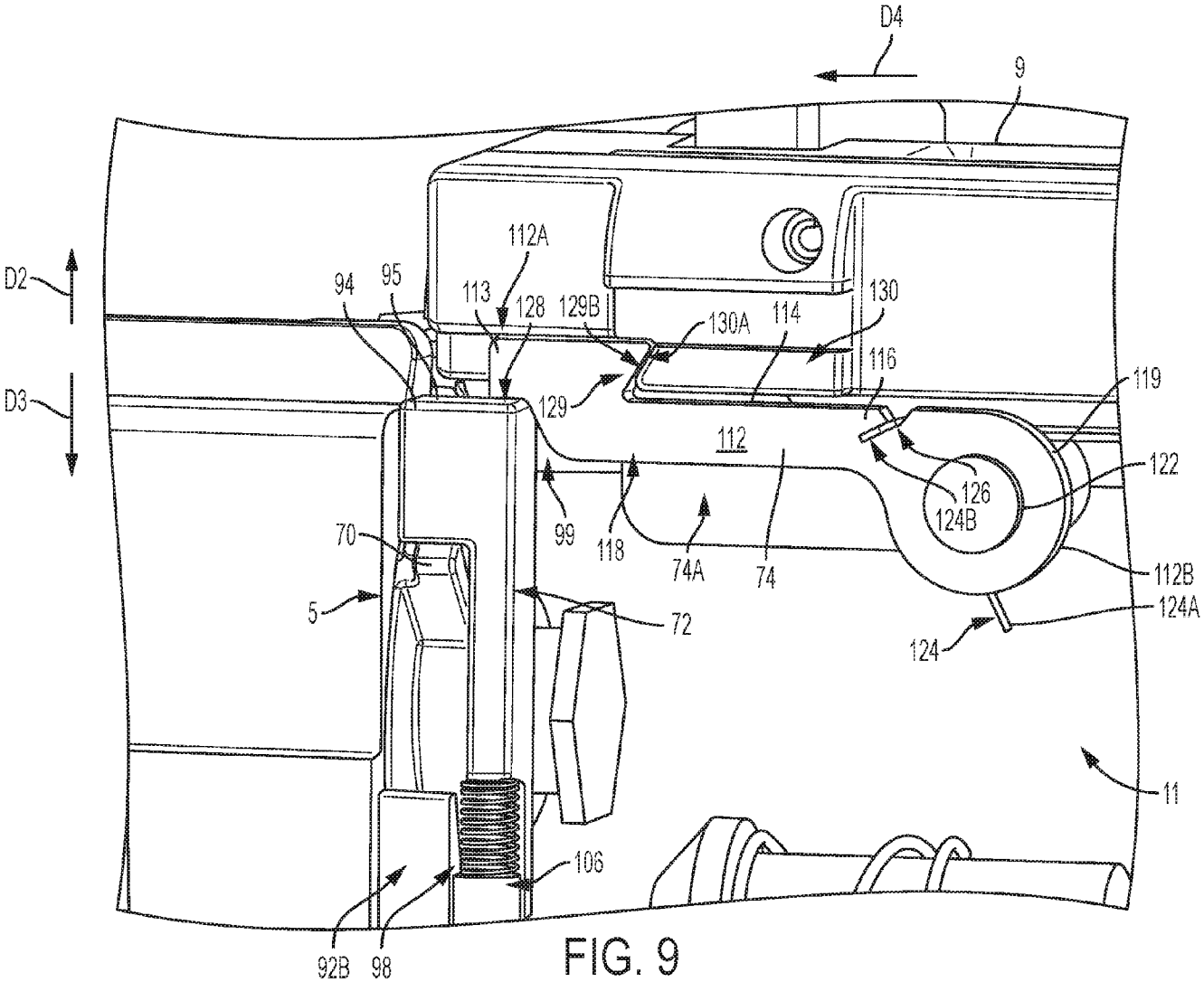
FIG. 9 is a side view of the bolt hold open assembly/system according to principles of the disclosure, with the bolt hold open lever in a closed position.

As shown in FIGS. 4A-D and 6-7, the paddle 70 may include a body 76 with opposing facing side faces or surfaces 78/80, and an upper or top portion 82 that has curved or beveled surfaces 82A and a top face or surface 82B. The curved or beveled surfaces 82A may extend at least partially between the side faces or surfaces 78/80 and the top face or surface 82A of the paddle 70. The paddle 70 can be formed with or connected to the retention disk 38 arranged along the rotor body 32, though the present disclosure is not limited to this particular construction/arrangement and the rotor retention disk may be removed or the paddle 70 may otherwise be arranged along and/or rotated with the rotor body 32 in a spaced relationship therewith. The paddle 70 will rotate with the rotor body as rounds are fed from the magazines and, as the last round is fed from the magazine, the paddle 70 may engage and/or activate the bolt hold open riser to cause it to move it into bearing engagement with the bolt hold open lever. For example, as shown in FIGS. 7-9, the paddle 70 may be brought into engagement with the bolt hold open riser 72 and can move the bolt hold open riser 72 in an upward direction D1 to urge the bolt hold open lever 74 towards and into its locked position 74A.

FIG. 7 further shows that the follower 50 of the magazine also may be moved into/along the feed throat 26 by a selected/prescribed amount or distance so that the rotary body can be sufficiently rotated to bring the paddle 70 into engagement with at least a portion of the bolt hold open riser 72 for moving the bolt hold open lever 74 forward to its locking position 74A. Though the paddle 70 is shown to engage the bolt hold open riser 72 to move the bolt hold open lever 74, the paddle 70 may be otherwise configured or arranged to directly activate or engage the bolt hold open lever 74, or another component, for moving the bolt hold open lever 74 to its locking position after firing of the final round, as the bolt cycles rearwardly, without departing from this disclosure. FIGS. 5-7 show that the paddle or flange 70 may move or rotate with the rotor body along a passage or path 84 defined along/within the back plate 17 of the magazine housing 12. In addition, the back plate 17 (FIG. 5) can include a barrier or partition 88 arranged at least partially within the path 84 to engage the paddle 70 and thereby stop or inhibit rotation, or movement, of the rotor body 32. This barrier or partition 88 can engage at least a portion of the paddle 70 to prevent over rotation of the rotor body 32, such as when the last round has been loaded into the firearm chamber, or during loading of the rounds of ammunition into the magazine 10.

As further shown in FIGS. 5-7, the bolt hold open riser 72 can include a body 92 with a substantially rectangular shape, though other shapes including cylindrical, oval, square or other suitable shapes can be used, without departing from this disclosure. The body 92 of the bolt hold open riser 72 also can have a protruding portion 94 arranged proximal or adjacent an upper end 92A thereof, which protruding portion 94 can have a body 96 with a generally rectangular or square shape, though other shapes, such as oval or circular shapes, also are possible. The body 96 of the protruding portion 94 will have opposing upper 95 and lower 97 faces or surfaces, which may be substantially planar or flat, although generally curved or other shaped surfaces, are possible without departing from this disclosure. The lower surface 97 may be positioned to be engaged by at least a portion of the paddle 70, e.g., curved surface 82A, to move the bolt hold open riser 72 in an upward/upper direction D2 (FIG. 7) to actuate or move the bolt hold open lever to its raised, locking position 74A (FIG. 9). Optionally, the bolt hold open riser 72 may be biased in a downward direction D3, such as by a spring or other biasing member 98 (FIGS. 5 and 7).

The bolt hold open riser 72 additionally can have a projection or flange 104 along, proximate or adjacent the lower end 92B of its body 92, with the spring 98 arranged between a wall or shoulder 106 of the back plate 17 and the projection 104 in a position to bias the bolt hold open riser 72 in the downward direction D3. However, the bolt hold open riser 72 can be unbiased without departing from this disclosure.

FIGS. 5-7 further show that bolt hold open riser 72 may be at least partially positioned within and movable/slidable along a groove 108 defined along the back plate 17 of the magazine housing or body. As a result, the bolt hold open riser 72 can be extended at least partially out of opening 110 in the top portion 18 of the magazine housing 12 to activate or engage the bolt hold open lever 74 and move it to its locking position 74A to substantially prevent, arrest or inhibit the return, forwardly translating movement of the bolt assembly along the receiver. Though the bolt hold open riser 72 is shown as received at least partially within the magazine housing 12, the bolt hold open riser 72 also can be otherwise positioned, arranged or configured without departing from this disclosure. For example, the bolt hold open riser 72 may be received within a groove or recess defined along an exterior surface of the magazine housing.

The bolt hold open riser 72 of the bolt hold open engagement assembly of the rotary magazine 10 generally can be configured to interact with an existing bolt hold open lever of the firearm, such as the existing bolt hold open lever of an M4 or AR-style firearm. It also can interact with a bolt hold open lever 74 that can be an after-market part attached to, made/manufactured with, the firearm F. For example, as shown in FIGS. 8-9 in one embodiment, the bolt hold open lever 74 can include a body 112 with front 113, top 114, side 116, bottom 118, and rear 119 portions or surfaces. The bolt hold open lever 74 may be movable between lowered position 74B away from engagement with the bolt assembly to allow the bolt assembly 9 to freely translate along the receiver and a raised or locking position 74A whereby the bolt hold open lever will engage and substantially arrest or prevent forward movement of the bolt assembly after the last round of ammunition has been fired. The bolt hold open lever 74 further can be biased towards its lowered, non-engaging position 74B during normal operation of the firearm.

The body 112 of the bolt hold open lever 74 will be coupled or mounted to the receiver 4 or other component of the firearm F, at or adjacent a proximal end 112B thereof, such as by a fastener 120, e.g., a bolt assembly, a screw, rivet, pin, or press-stud, received through an opening 122 defined in the body 112 of the bolt hold open lever 74. A biasing member, such as a torsion spring 124, further may be located along this fastener 120, with a first end 124A of the biasing spring 124 fixed to or engaging a portion of the receiver or frame of the firearm, while its second end 124B can be at least partially received within a notch or recess 126 defined in the top portion 114 of the body 112 of the bolt hold open lever 74 to thereby force or urge the body 112 of the bolt hold open lever 74 generally in a downward direction D3 towards its non-engaging position 74B.

FIGS. 8-9 further show that the body 112 of the bolt hold open lever 74 can have an engagement portion or surface 128 at its front end 112A that is configured to be engaged or contacted by at least a portion of the body 92 of the bolt hold open riser 72, such as the upper face/surface 95 of the protruding portion 94, to move the bolt hold open lever 74 from its non-engaging position 74B whereby the bolt assembly 9 is free to translate along the receiver 3 to its closed, engaged or locking position 74A that substantially prevents movement of the bolt assembly 9 in the forward direction. Additionally, the body 112 of the bolt hold open lever 74 will have a notch or recess 129 defined along its top surface 114, which can define a catch or an angled or slanted surface or face 129A configured to engage at least a portion of the bolt assembly as it cycles in a forward direction D4 after firing of the last round.

In one embodiment, the bolt assembly can have a projecting portion 130 with an angled or slanted surface or face 130A that is configured to be brought into face-to-face contact or otherwise engage the angled surface 129A defined by the notch 129 of the bolt hold open lever 74 when the bolt hold open lever 74 is in its raised, closed position 74A. The angles of these surfaces 129A/130A can be selected such that the bolt assembly at least partially supports the bolt hold open lever 74 in its raised, locking position 74A, and also may cause the bolt hold open lever 74 to be moved or urged towards its raised, locked position 74A as the bolt assembly is biased against the bolt hold open lever 74, but still enables the release of such engagement when the bolt hold is pushed/activated by a user. The angle of these surfaces 129A/130A can be selected from a range of approximately 45° to approximately 70°, such as about 58°, with respect to the horizontal top surface of the bolt hold open lever. However, any angle(s) that will maintain the bolt hold open lever in its raised, locking position can be selected, and this angle further may depend on the dimensions, size or configuration of the bolt hold open lever, such as a distance or length between the pivotable connect between the bolt hold open lever and the fire control and the notch/recess.

In addition, the bolt hold open lever 74 may be formed with prescribed sizes, dimensions, or configurations such that the bolt hold open level 74 is located at or projects for a selected length along the receiver such that the bolt assembly's forward movement can be substantially arrested/stopped before the bolt assembly reaches a specific velocity or develops a significant amount of inertia/forward momentum, so as to help minimize and/or avoid damage to the bolt assembly, the bolt hold open lever, the fire control, the receiver, magazine and/or other components of the firearm.

In one embodiment, the bolt hold open assembly 5 for holding/maintaining the bolt assembly in a substantially open position, and/or inhibiting forward movement of the bolt assembly, after firing of the last round of ammunition fed from the rotary magazine 10 may operate in the following manner. Rounds of ammunition 100 (FIG. 6) can be loaded into the interior cavity 24 of the magazine housing 12, such as through an opening 28 in a feed throat 26 located along a top portion 18 of the magazine housing 12. The rounds loaded into the rotary magazine 10 will be at received along spaced recesses or notches 36 of a cylindrical rotor 30 that is rotatably biased to feed the rounds toward and into the feed throat 26 for loading into the firearm. The rounds generally will be urged and moved toward and through the feed throat by a lower/adjacent round as the rotor rotates so that the next rounds can be stripped by the bolt assembly and urged toward/into the chamber 3 of the firearm F for firing.

A last round of ammunition may be urged or moved through the feed throat by a follower 50 (FIG. 7) pivotably mounted along the rotor. As the last round stored in the magazine is through the feed throat and loaded into the firearm chamber, a paddle 70 located along the rotor will be moved into engagement with a hold open riser 72, causing it to activate or move the bolt hold open lever 74 to its locking position to prevent forward movement of the bolt assembly. The follower 50 also can be configured to move into or along the feed throat a sufficient amount to help ensure that the paddle activate or move the bolt hold open riser.

As a result, the bolt hold open lever 74 will be moved from a lowered, non-engaging position towards position to be engaged with and thus substantially inhibit or block substantial forward movement of the bolt assembly as it is cycled after firing of the last round of ammunition. The bolt hold open lever may be moved towards its engaging position while the bolt assembly is cycling in the rearward direction upon firing of the last round, with the bolt hold open lever 74 in sliding contact against at least a portion of the bolt assembly, whereupon it can fully move into engagement with the bolt assembly when the bolt assembly has been sufficiently rearward such that a hook or catch of the bolt hold open lever 74 can move into a notch or recess defined by a body of the bolt assembly. This forward motion of the bolt assembly further may be substantially arrested after/as the bolt assembly 9 initially begins to move in the forward direction during cycling thereof after firing of the last round of ammunition, and before it has created a substantial return momentum or force.

In an alternative embodiment, the hold open riser 72 can be eliminated, and the paddle 70 of the rotor body can be configured to interact with the bolt hold open lever 74 to move it to its raised, locking position 74A. For example, an opening or aperture may be defined along the magazine housing 12, e.g., along back plate 17, with the paddle 70 projecting therefrom or being extensible out of the opening such that, as the rotor 32 is rotated to load the last round of ammunition toward or through the feed throat 26, the paddle 70 can at least partially contact or otherwise engage the bolt hold open lever 74, or other components in communication therewith, to move or direct the bolt hold open lever into its locking position 74A (not shown).

Figure 10A:
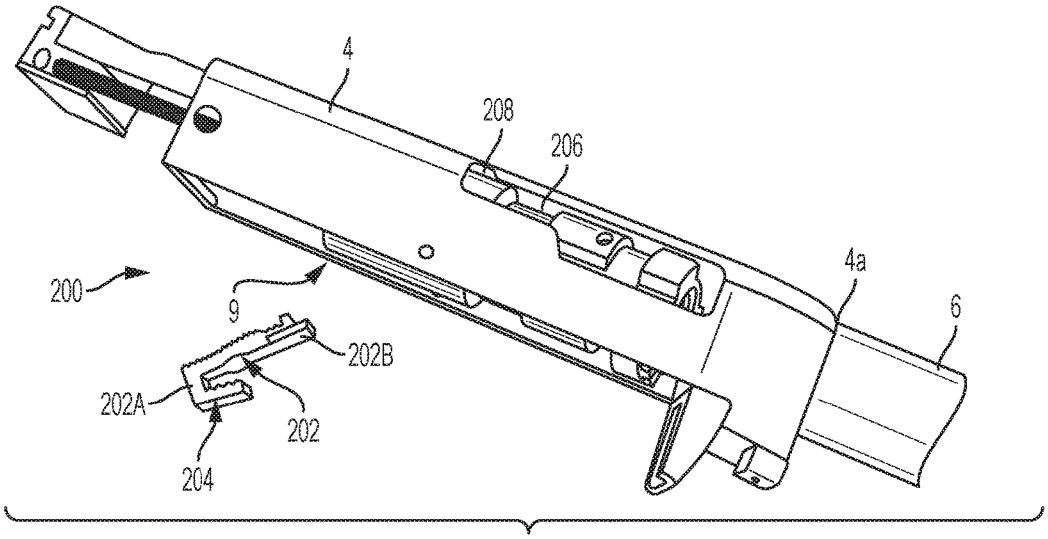
FIGS. 10A-C are exploded and perspective views of a manual bolt hold open assembly according to principles of this disclosure.
Figure 10B:
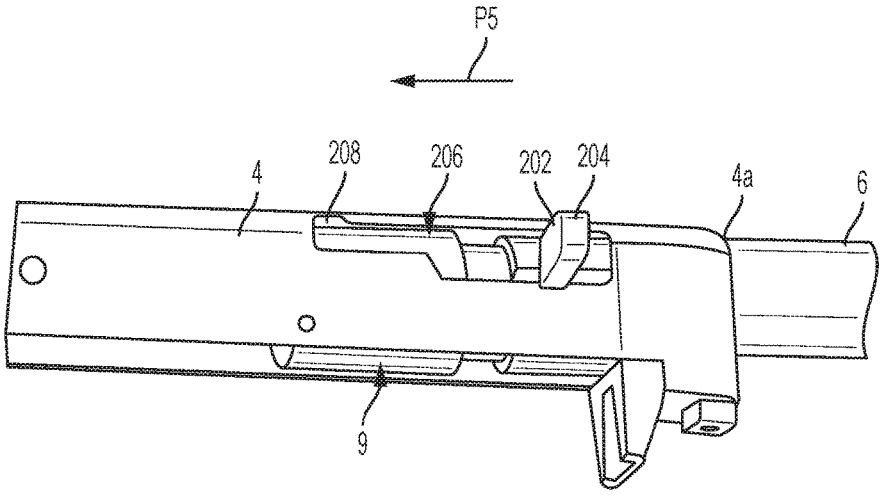
Figure 10C:
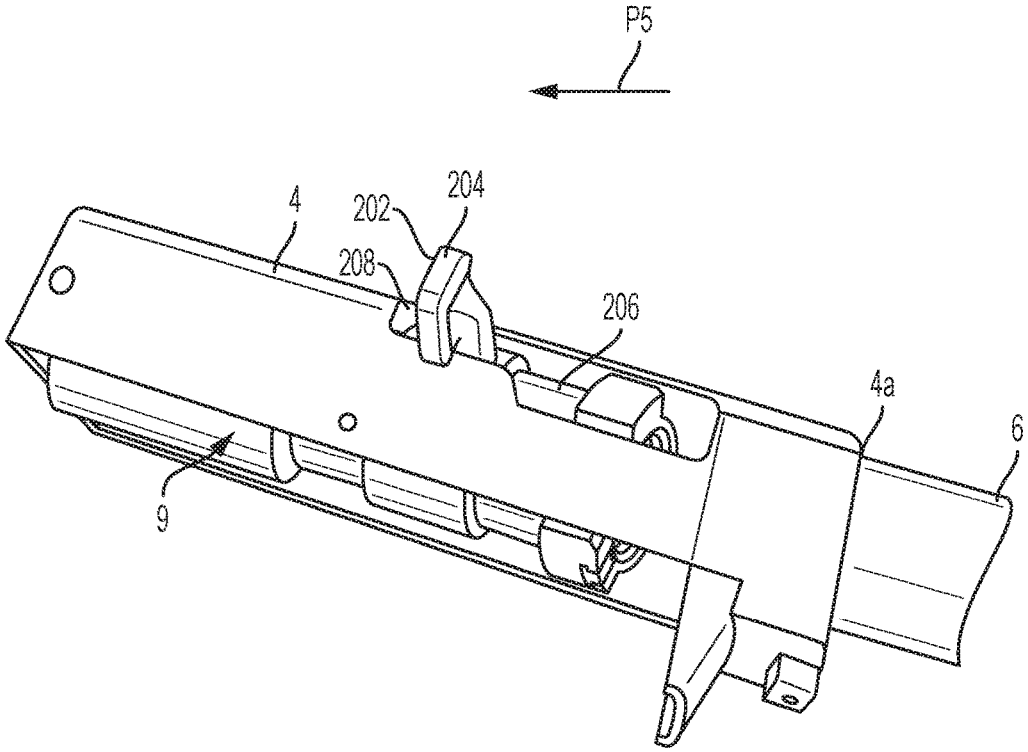

FIGS. 10A-10C show a manual bolt hold open assembly 200 according to principles of this disclosure. The manual bolt hold open assembly 200 can operable to enable an operator to manually move or translate the bolt assembly 9 along the receiver 4 and lock the bolt assembly 9 in its open position. This manual bolt hold open assembly 200 will include a body 202 that can be removably fixed or coupled to the bolt assembly 9 of the firearm at a first end 202B, and can include a handle or lever portion 204 arranged along an opposite end 202A thereof. The body 202 can be movable with the bolt assembly as it translates along the receiver during cycling of the firearm. For example, the at least a portion of the lever or handle 204 can extend through an opening or a slot 206 defined along a side portion of the receiver. The operator of the firearm can pull or push the handle/lever 204 to move the bolt assembly along the receiver. For example, the bolt assembly can be manually moved towards its opened position when an operator pulls the handle in a rearward direction D5, whereupon the handle/lever 204 further can be moved or actuated, i.e., pulled out from or pushed toward the receiver, or otherwise caused to engage the bolt assembly, such that at least a portion of its body 202 bears against a notch or recess 208 defined along the opening 206 in the receiver to retain the bolt assembly in its open position.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A firearm, comprising:

a receiver;

a barrel configured to couple to the receiver and defining a chamber adapted to receive a round of ammunition for firing from the firearm;

a bolt assembly including a bolt movable along the receiver for directing rounds of ammunition toward the chamber of the barrel;

a bolt hold open assembly comprising a bolt hold open lever movable between a raised position substantially inhibiting movement of the bolt and holding the bolt in an open position, and a lowered position allowing movement of the bolt along the receiver; and a rotary magazine at least partially received within a magazine well in communication with the receiver, the rotary magazine comprising:

a magazine housing defining an interior chamber for receiving and storing the rounds of ammunition;

a magazine rotor mounted to the magazine housing and having a series of spaced protrusions arranged thereabout and which define a series of recesses configured to at least partially receive the rounds of ammunition for feeding the rounds of ammunition from the interior chamber of the magazine housing as the magazine rotor is rotated; and a protruding portion rotatable with the magazine rotor and operable to urge the bolt hold open lever toward the raised position after a last round of ammunition fed from the rotary magazine has been fired from the firearm; and a magazine follower coupled to a protrusion of the series of spaced protrusions so as to be movable therewith to engage and urge the last round of ammunition contained within the rotary magazine through a feed throat of the magazine housing, wherein the magazine follower is configured to move into the feed throat of the magazine housing a distance sufficient to enable rotation of the protruding portion of the rotary magazine to a position for moving the bolt hold open riser to the raised position.

2. The firearm of claim 1, wherein when the bolt hold open lever is in the raised position, the bolt hold open lever engages the bolt as the bolt is cycled forward and before the bolt generates a substantial amount of momentum or velocity in the forward direction.

3. The firearm of claim 1, further comprising a bolt hold open riser at least partially received within and slidable along the magazine housing, the bolt hold open riser in communication with the bolt hold open lever and configured to be engaged by the protruding portion of the rotary magazine upon movement thereof to move the bolt hold open lever into the raised position.

4. The firearm of claim 3, wherein the bolt hold open riser comprises a body with a projection arranged therealong, the projection including an engagement surface located in a position so as to be at least partially engaged by the protruding portion of the rotary magazine.

5. The firearm of claim 4, wherein the protruding portion of the rotary magazine comprises a body with opposing side surfaces and a curved surface extending at least partially between the opposing side surfaces, wherein the curved surface at least partially engages the engagement surface of the projection of the bolt hold open riser so as to urge the bolt hold open riser in a direction toward engagement with the bolt hold open lever and move the bolt hold open lever toward the raised position.

6. The firearm of claim 5, further comprising a biasing member mounted within the housing and biasing the body of the bolt hold open riser toward a downward direction.

7. The firearm of claim 1, wherein the bolt hold open lever comprises a lever body having a notch defined therealong and configured to engage at least a portion of the bolt as the bolt is moved forwardly when the bolt hold open lever is in the raised position.

8. The firearm of claim 7, wherein the bolt further comprises a body portion including an engagement surface configured to engage a corresponding surface defined by the notch of the lever body.

9. The firearm of claim 8, wherein the engagement surface of the bolt and/or the corresponding surface of the lever body are angled or slanted such that the bolt at least partially supports the bolt hold open lever in the raised position.

10. A firearm, comprising:

a receiver;

a barrel having a proximal end and a distal end, with a chamber defined at the proximal end, and with the proximal end of the barrel configured to be coupled to the receiver;

a bolt assembly received within the receiver and including a bolt translatable along the receiver to urge rounds of ammunition towards the chamber;

a bolt hold open lever mounted adjacent the bolt assembly and movable between a first position that allows the bolt to substantially freely translate about the receiver, and a second position that holds or locks the bolt in an open position, the bolt hold open lever comprising a lever body having a notch that is at least partially engaged by a complimentary engagement surface of the bolt as the bolt moves forwardly and the bolt hold open lever is in the second position; and a rotary magazine received within the receiver and configured to receive and store the rounds of ammunition for feeding into the chamber of the firearm, the rotary magazine comprising:

a magazine housing having a feed throat through which the rounds of ammunition are fed from the rotary magazine;

a magazine rotor at least partially received within the magazine housing and comprising a body with a plurality of spaced notches that each are configured or sized to at least partially receive a round of ammunition therein, wherein the magazine rotor is rotationally biased for urging the rounds of ammunition received within the notches thereof toward the feed throat;

a protruding portion supported by and rotatable with the magazine rotor; and a bolt hold open riser in communication with the bolt hold open lever and configured to be engaged by the protruding portion as a last round of ammunition is moved by the magazine rotor toward or into the feed throat to move the bolt hold open lever to the second position.

11. The firearm of claim 10, wherein the bolt hold open riser is at least partially received within and movable along the magazine housing, and comprises a body having an engagement surface located therealong so as to be at least partially engaged by the protruding portion of the rotary magazine.

12. The firearm of claim 11, wherein the protruding portion of the rotary magazine further comprises a body with a pair of spaced side surfaces and a curved surface extending at least partially therebetween, and wherein the curved surface at least partially engages the engagement surface of the bolt hold open riser to move the bolt hold open riser with the rotation of the magazine rotor in a direction to at least partially engage and move the bolt hold open lever toward the second position.

13. The firearm of claim 10, wherein the complimentary engagement surface of the bolt and/or the notch of the lever body of the bolt hold open lever are angled or slanted such that the bolt at least partially supports the bolt hold open lever in the second position.

14. The firearm of claim 10, further comprising a magazine follower rotatably coupled to a last protrusion of a series of spaced protrusions defined about the magazine rotor and configured to move therewith so as to urge the last round of ammunition through the feed throat of the magazine housing; and wherein the magazine follower moves a sufficient distance into the feed throat to allow for rotation of the protruding portion of the rotary magazine to move the bolt hold open riser to the second position.

15. A rotary magazine for storing rounds of ammunition for firing from a firearm, comprising:

a magazine housing comprising an interior cavity and a feed throat in communication with the interior cavity;

a magazine rotor at least partially received within the magazine housing and comprising a body having a plurality of spaced projections defining a series of notches configured or sized to at least partially receive a round of ammunition, and wherein the magazine rotor is rotationally biased sufficiently to feed rounds of ammunition received within the notches toward and through the feed throat;

a bolt hold open assembly comprising a bolt hold open lever that is movable between a lowered position and a raised position that substantially inhibits forward movement of a bolt assembly of the firearm;

a bolt hold open riser received within the magazine housing and movable into engagement with the bolt hold open assembly;

a protruding portion coupled to and rotatable with the magazine rotor so as to urge the bolt hold open riser toward engagement with and activation of the bolt hold open assembly; and a magazine follower coupled to and rotatable with the magazine rotor and configured to urge a last round of ammunition through the feed throat, wherein the magazine follower is moveable into the feed throat sufficient to allow rotation of the protruding portion to move the bolt hold open lever to the raised position.

16. The rotary magazine of claim 15, wherein the magazine follower comprises an elongated body sized and/or dimensioned to be at least partially received within a notch defined along the magazine rotor; and a flange coupled to the magazine follower so that the elongated body of the magazine follower is rotatable thereabout.

17. The rotary magazine of claim 15, wherein the bolt hold open riser is at least partially received within the magazine housing, and comprises a body having an engagement surface configured to be at least partially engaged by the protruding portion of the rotary magazine.

* * * * *